United States Patent [19]

Schwartz et al.

[11] 4,390,440

[45] Jun. 28, 1983

[54] THICKENED WATER-BASED HYDRAULIC FLUIDS

[75] Inventors: Ellen S. Schwartz, Warren; Cline A. Tichner, Grosse Ile, both of Mich.

[73] Assignee: BASF Wyandotte Corporation, Wyandotte, Mich.

[21] Appl. No.: 271,593

[22] Filed: Jun. 8, 1981

[51] Int. Cl.[3] ..... C10M 3/04; C10M 3/18; C10M 3/22

[52] U.S. Cl. ..... 252/76; 252/77; 252/78.1; 252/78.5; 252/79; 548/347; 548/355; 568/679; 568/680

[58] Field of Search ..... 252/76, 77, 78.1, 79, 252/78.5; 548/347, 355; 568/679, 680

[56] References Cited

U.S. PATENT DOCUMENTS

| | | | |
|---|---|---|---|
| 3,277,001 | 10/1966 | Fischer et al. | 252/32.5 |
| 3,346,501 | 10/1967 | Boehmer | 252/73 |
| 3,629,111 | 12/1971 | Cramer | 252/75 |
| 4,105,580 | 8/1978 | Sebag et al. | 252/351 |
| 4,138,346 | 2/1979 | Nassry et al. | 252/32.5 |
| 4,151,099 | 4/1979 | Nassry et al. | 252/32.7 |
| 4,288,639 | 9/1981 | Camp | 568/625 |
| 4,310,436 | 1/1982 | Camp | 252/316 |
| 4,312,768 | 1/1982 | Nassry et al. | 252/32.7 |
| 4,312,775 | 1/1982 | Panek et al. | 252/316 |
| 4,342,658 | 8/1982 | Tincher et al. | 252/32.5 |
| 4,354,956 | 10/1982 | Camp | 252/316 |

FOREIGN PATENT DOCUMENTS

| | | | |
|---|---|---|---|
| 54-6062895 | 10/1979 | Japan | 252/77 |

*Primary Examiner*—John E. Kittle
*Assistant Examiner*—Robert A. Wax
*Attorney, Agent, or Firm*—Andrew E. Pierce; Bernhard R. Swick

[57] ABSTRACT

In accordance with the instant invention, a water-based hydraulic fluid, having improved viscosity can be obtained by blending a carboxylic acid with a thickened hydraulic fluid composition employing a thickener obtained by modifying a conventional polyether polyol thickening agent with an alpha-olefin epoxide or glycidyl ether having about 10 to 24 carbon atoms or mixtures thereof. Small amounts of higher molecular weight glycols may also be incorporated into the chain.

42 Claims, No Drawings

THICKENED WATER-BASED HYDRAULIC FLUIDS

BACKGROUND OF THE INVENTION

1. Field of the Invention

This invention relates to water-based hydraulic fluids thickened with water-soluble polymers characterized by improved viscosity.

2. Prior Art

In the technology of hydraulic power transmission, mechanical power is imparted to a fluid called "a hydraulic fluid" in the form of pressure by means of a hydraulic pump. Power is utilized where desired by tapping a source of said hydraulic fluid thus transforming the power as pressure back to mechanical motion by a mechanism called a hydraulic motor. The hydraulic fluid is utilized as a pressure and volume transmitting medium. Any non-compressible fluid can perform this function. Water is the oldest fluid used for this purpose and is still sometimes used alone for this purpose. In the prior art, there has been a heavy emphasis on the development of petroleum oils for use as hydraulic fluids and, consequently, much of the equipment utilized with hydraulic fluids has been designed and manufactured specifically for use with petroleum oils. A petroleum oil in comparison with water as a hydraulic fluid possesses the advantage of inhibiting the development of rust of the ferrous components of the mechanical equipment utilized in conjunction with hydraulic fluids, (i.e., hydraulic pumps, motors, etc.) and in preventing wear of the machinery since the hydraulic fluid must lubricate the equipment. Petroleum oils have a second advantage over the use of water as a hydraulic fluid in that the petroleum oils normally exhibit a substantially higher viscosity than water and thus contribute to reduction of the leakage of the fluid in the mechanical equipment utilized. In addition, the technology relating to additives for petroleum oils has developed to such an extent that the viscosity, foam stability, wear prevention and corrosion prevention properties of such petroleum oil-based hydraulic fluids can be further enhanced by the use of said additives.

Over the past 25 years, various substitutes for petroleum oil-based hydraulic fluids have been developed in order to overcome one of the major deficiencies of petroleum oils, namely, flammability. Recent interest in the use of hydraulic fluids having up to 99 percent or more of water has resulted from the higher cost of petroleum oils and recent emphasis on problems of ecologically suitable disposal of contaminated or spent petroleum oil-based hydraulic fluids.

Metalworking fluids of the so-called "soluble oil" type have been considered for use as hydraulic fluids. Such fluids contain mineral oil and emulsifiers as well as various additives to increase corrosion resistance and improve antiwear and defoaming properties. Such fluids, when used as hydraulic fluids, are not generally suitable for use in ordinary industrial equipment designed specifically for use with the petroleum oil-based hydraulic fluids since such fluids do not adequately prevent wear damage in some types of pumps and valves of each equipment. However, such fluids have found application in specially designed, high cost, large size equipment which, because of said large size and thus inflexibility, is not suitable for use in most industrial plants. The soluble oil hydraulic fluid usage has thus been quite limited; usage has been largely confined to large installations where flexibility and size are not critical, such as in steel mills.

It is also known to use, in equipment designed for use in mineral oil-based hydraulic fluids, flame-resistant glycol-water based hydraulic fluids such as are disclosed in U.S. Pat. No. 2,947,699. Up until recently, water-based hydraulic fluids containing about 70 to 99+ percent water, have had very poor lubricating characteristics. While hydraulic fluids are used primarily to transmit forces, it is necessary that they provide lubrication for the impeller, rings, vanes, gears, pistons and cylinders and other mechanical parts of hydraulic pumps in such systems in order to prevent excessive wear on such parts.

Many prior art fluids, such as the petroleum oil type, are highly flammable and unsuitable for certain uses where such fluids have frequently been the source of fire. Where these fluids are used to control such industrial operations as heavy casting machines, which are operated largely by hydraulic means, danger of fire exists. Therefore, there is a growing demand for hydraulic fluids characterized by reduced flammability.

Hydraulic fluid compositions having water as a base are disclosed in U.S. Pat. Nos. 4,151,099 and 4,138,346. These patents disclose fluids comprising (1) a sulfur containing compound and (2) a phosphate ester salt. The U.S. Pat. No. 4,151,099 also includes a water-soluble polyoxyethylated ester of an aliphatic acid and a monohydric or polyhydric aliphatic alcohol, either one or both said acid and said alcohol being polyoxyethylated. These hydraulic fluids are optionally thickened with a polyglycol thickener.

In U.S. Pat. No. 2,558,030 a hydraulic fluid is disclosed having an organic polymeric thickener such as copolymers of ethylene oxide and propylene oxide having high molecular weight.

U.S. Pat. No. 2,602,780 discloses hydraulic fluids with soluble polymeric thickeners such as copolymers of ethylene oxide and propylene oxide having molecular weights of 15,000 to 20,000.

From the above it can be seen that it is well known in the art to employ in hydraulic fluids organic polymeric thickeners such as copolymers of ethylene oxide and propylene oxide having high molecular weight.

| Relevant Patents | | | |
|---|---|---|---|
| U.S. Pat. No. | Issued | Inventor(s) | Assignee |
| 3,580,847 | 5/25/71 | Boehmer et al | BWC |
| 3,657,133 | 4/18/72 | Miller | Shell Oil |
| 3,346,501 | 10/10/67 | Boehmer | BWC |
| 3,629,111 | 12/21/71 | Cramer | Olin |

U.S. Pat. No. 3,346,501 discloses hydraulic fluids containing a conventional polyoxyalkylene thickener, i.e., copolymers of ethylene oxide and 1,2-propylene oxide having molecular weights of about 10,000 to 25,000 along with lauric acid and capric acid as antifoaming agents in a conventional aqueous hydraulic fluid.

U.S. Pat. No. 3,580,847 discloses hydraulic fluid compositions employing high molecular weight polyoxyalkylene polymers as thickeners along with acids such as lauric. This patent calls for a two-phase hydraulic fluid with one phase floating on the other, the floating phase being a mineral oil or something similar.

U.S. Pat. No. 3,657,133 discloses a functional fluid such as transmission fluid which includes acids such as lauric acid in combination with polyoxyalkylene glycols.

U.S. Pat. No. 3,629,111 discloses hydraulic fluids containing polyoxyalkylene glycols along with capric and lauric acids. This patent is directed to use of a novel inhibitor composition comprising a hydrazine compound with the organic acid.

SUMMARY OF THE INVENTION

This invention relates to thickened water-based hydraulic fluids. Such fluids are prepared by blending water, organic thickener and conventional hydraulic fluid additives. In accordance with the instant invention, it has been discovered that a substantial increase in viscosity of a hydraulic fluid, thickened with a specified type of thickener is achieved by blending with the fluid a very small amount of a carboxylic acid having about 5 to 20 carbon atoms. The addition of a carboxylic acid has been found to substantially increase the viscosity of a hydraulic fluid employing a thickener obtained by modifying a conventional polyether polyol thickening agent with an alpha-olefin epoxide or glycidyl ether having about 10 to 24 carbon atoms or mixtures thereof. Small amounts of higher molecular weight glycols may also be incorporated into the chain. The hydraulic fluid may be prepared by first preparing a concentrate containing from about 0 to 85 percent by weight of water which is a most convenient form for shipping and which after shipping is then further diluted with about 25 to 99 percent by weight water. The preparation and shipping of such concentrates is preferred for high water type fluids. However, water glycol type fluids are preferably prepared and shipped in the final or ready to use form.

The above carboxylic acids which are added to increase viscosity in combination with the specified thickener may be added to the thickener, the concentrate or to a finally prepared hydraulic fluid.

DESCRIPTION OF THE PREFERRED EMBODIMENTS

In accordance with the instant invention the thickener is obtained by modifying a conventional polyether polyol thickening agent with an alpha-olefin epoxide having about 10 to 24 carbon atoms or mixtures thereof. Actually, any epoxide with a molecular weight of about 150 to 300 may be employed. Any alcohol or aliphatic (or possibly even aromatic) group of 10 to 24 carbons that can be placed at the end of the polyol chain may be employed in lieu of the alpha-olefin epoxide. Glycidyl ethers make excellent caps. A little ethylene oxide, propylene oxide or butylene oxide beyond the cap may be employed. Small amounts of higher molecular weight glycols may be incorporated into the chain. The conventional polyether polyol thickening agent can be an ethylene oxide homopolymer or a straight or branched chain heteric or block copolymer of ethylene oxide and at least one lower alkylene oxide having 3 to 4 carbon atoms. Said ethylene oxide is used in the proportion of at least about 60 percent by weight based upon the total weight of the polyether polyol. Generally, about 70 to 100 percent by weight ethylene oxide is utilized with about 30 to 0 percent by weight of lower alkylene oxide having 3 to 4 carbon atoms.

Such polyether polyols are generally prepared by reacting an active hydrogen-containing compound having 1,2,3 or more active hydrogens with the ethylene oxide or ethylene oxide and said lower alkylene oxide in the presence of an acid or basic oxyalkylation catalyst and an inert organic solvent at elevated temperatures in the range of about 50° C. to 150° C. under an inert gas pressure generally from about 20 to about 100 pounds per square inch gauge. Polyether polyols suitable as thickeners can be prepared by further reacting a conventional polyether polyol as described above having a molecular weight of about 1000 to about 40,000, preferably 2000 to about 30,000 with the above-described epoxides, alcohols, glycidyl ethers, etc., so as to provide a cap on the polyether polyol. The amount of epoxide, alcohol, glycidyl ethers, etc., required to obtain the modified polyether polyol thickening agents of the invention is about 1 to about 20 percent by weight based upon the total weight of the modified polyether polyol thickeners. Alternatively, the modified polyether polyol thickening agents can be obtained by the copolymerization of a mixture of ethylene oxide and at least one other lower alkylene oxide having 3 to 4 carbon atoms with an alpha-olefin epoxide having about 12 to 18 carbon atoms or mixtures thereof. Further details of the preparation of the alpha-olefin epoxide modified polyether polyol thickening agents useful in the preparation of the hydraulic fluids of the invention can be obtained from co-pending applications Ser. No. 86,837 filed on Oct. 22, 1979 and Ser. No. 86,840 filed Oct. 22, 1979, both incorporated herein by reference.

Generally, about 10 to 60 percent of such thickeners based on the weight of the concentrate, or 1 to 20 percent based on the weight of the final hydraulic fluid is employed.

In order to substantially increase viscosity in a hydraulic fluid employing the above-described thickener, a carboxylic acid having 5 to 20 carbon atoms per COOH group and mixtures thereof are blended with said fluid.

Referred carboxylic acids for increasing viscosity in the presence of the above-described thickener are lauric acid, capric acid, neodecanoic acid, stearic acid, palmitic acid, oleic acid, sebacic acid, and 4-octylbenzoic acid.

While decanoic, also known as capric, acid has been well known in the art for years, the neoacids, which are synthetic highly-branched organic acids, are relatively new. The "neo" structure is generally considered to be as follows:

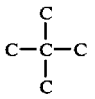

This product is described in the article entitled "Neoacids: Synthetic Highly Branched Organic Acids", *Journal of American Oil Chemists Society*, Vol. 55, No. 4, pp. 342A to 345A (1978).

Each of the above carboxylic acids may be used singly or in combination with one or more of the other carboxylic acids set forth above. Generally the total amount of said carboxylic acids would range from about 0.1 to 2 percent by weight in the final hydraulic fluid. Where a concentrate is prepared first, the amount of said compounds would be about 0.5 to 20 percent based on the weight of the concentrate.

The carboxylic acids described above may be employed with any conventional hydraulic fluid incorporating any or all of the following prior art components. For example, the hydraulic fluid may contain one or more of the following, as disclosed in U.S. Pat. Nos. 4,151,099 and 4,138,346; a phosphate ester, a sulfur compound, a water-soluble polyoxyethylated aliphatic ester or ether and an alkyldialkanolamide. The fluid may be a high water fluid or a water-glycol type fluid. Optionally, the fluids of the invention can include a corrosion inhibitor, a defoamer and a metal deactivator (chelating agent) as well as other conventional additives, such as dyes in normal amounts.

The phosphate ester may be selected from the group consisting of

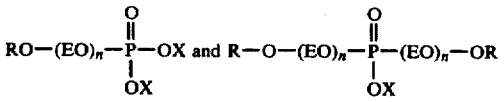

and mixtures thereof wherein ethylene oxide groups are represented by EO; R is selected from the group consisting of linear or branched chain alkyl groups wherein said alkyl groups have about 6 to 30 carbon atoms, preferably about 8 to 20 carbon atoms, or alkylaryl groups wherein the alkyl groups have about 6 to 30 carbon atoms, preferably about 8 to 18 carbon atoms, and X preferably is selected from the group consisting of hydrogen, alkali or alkaline earth metal, the residue of ammonia or an amine and mixtures thereof, and n is a number from 1 to 50. Metals such as lithium, sodium, potassium, rubidium, cesium, calcium, strontium, and barium are examples of the alkali earth metal.

The free acid form of the phosphate ester is preferably utilized in preparing hydraulic fluids in accordance with compositions of the invention. These are more fully disclosed in U.S. Pat. Nos. 3,004,056 and 3,004,057, incorporated herein by reference. The free acid form may be converted to the salt form in situ in the preparation of the hydraulic fluids of the invention. Alternatively, the phosphate ester salts can be used directly.

Water-soluble esters of ethoxylated aliphatic acids and/or water soluble ethers of ethoxylated alcohols may be incorporated in the hydraulic fluid as an antiwear lubricant component. Preferred water-soluble esters or ethers are those of the ethoxylated $C_8$–$C_{36}$ aliphatic monohydric or polyhydric alcohols or aliphatic acids, and aliphatic dimer acids. The most desirable adducts are in the range of 10 to 20 carbons. Suitable esters of ethoxylated aliphatic acids or alcohols are disclosed in U.S. Pat. No. 4,151,099 particularly beginning in column 3 thereof which is hereby incorporated by reference.

Representative water-soluble polyoxyethylated esters having about 5 to about 20 moles of oxide per mole are the polyoxyethylene derivatives of the following esters; sorbitan monooleate, sorbitan trioleate, sorbitan monostearate, sorbitan tristearate, sorbitan monopalmitate, sorbitan monoisostearate, and sorbitan monolaurate.

Conventional sulfur compound additives may also be incorporated in the hydraulic fluid such as the ammonia, amine or metal salts of 2-mercaptobenzothiazole or 5-, 6- and 7-substituted 2-mercaptobenzothiazole, said salts being formed on neutralization of the free acid form of 2-mercaptobenzothiazole with a base. Such sulfur compounds are disclosed particularly beginning in column 5 of U.S. Pat. No. 4,138,346 which is hereby incorporated by reference.

The sulfur-containing compound may also be sulfurized oxymolybdenum and oxyantimony compounds represented by:

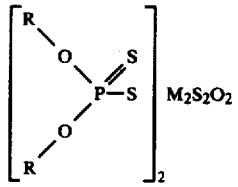

wherein M is molybdenum or antimony and R is organic and is selected from the group consisting of $C_3$–$C_{20}$ alkyl, aryl, alkylaryl radicals and mixtures thereof.

Representative useful molybdenum and antimony compounds are sulfurized oxymolybdenum or oxyantimony organo-phosphorodithioate where the organic portion is alkyl, aryl or alkylaryl and wherein said alkyl has a chain length of 3 to 20 carbon atoms.

The preferred alkyldialkanolamide has the formula

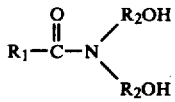

wherein $R_1$ is alkyl of about 4 to about 54, preferably about 4 to about 30, carbon atoms and $R_2$ is alkyl of about 2 to about 6 carbon atoms.

The alkyldialkanolamides are known compositions in the prior art. In general, these compositions are prepared by esterifying a dialkanolamine with an alkyl dicarboxylic acid and removing water of esterification. Useful alkyl dicarboxylic acids include branched or straight chain saturated or unsaturated aliphatic monocarboxylic or dicarboxylic acids as described below. Preferably, the saturated straight chain acids are used and the preferred amides are diethanolamides. Examples of useful alkyldialkanolamides are the alkyl diethanolamides and alkyl dipropanol amides where the alkyl group is derived from a $C_8$–$C_{54}$ dicarboxylic acid.

The advantageous properties contributed to the hydraulic fluid by the alkyldialkanolamide component of the hydraulic fluid of the invention are resistance to precipitation in the presence of hard water, that is, in the presence of large amounts of calcium and magnesium ions in the water utilized to prepare the hydraulic fluid of the invention. In addition, the alkyldialkanolamides contribute to the antiwear and extreme pressure performance of the composition as well as to the metal corrosion resistance which is desirable in such fluids. The alkyldialkanolamides in aqueous solution are completely stable under neutral and alkaline conditions and show little tendency to hydrolyze or decompose on storage.

The hydraulic fluids of the invention may consist of about 25 percent to about 99 percent water and about 75 percent to about 1 percent concentrate. These concentrates may comprise water, the viscosity increasing compound and thickener possibly in combination with a lower alcohol, the water-soluble esters of ethoxylated aliphatic acid and/or ethoxylated alcohol ethers and/or sulfur containing compound; and/or phosphate ester, and/or alkyldialkanolamide and, in addition, can contain defoamers, corrosion inhibitors and metal deactivators or chelating agents. Preferably, the final fluids consist of about 50 percent to 99 percent water and about 50 percent to about 1 percent concentrate. The fluids are easily formulated at room temperature. Generally, distilled or de-ionized water is used for water-glycol fluids and tap water is used for high water fluids.

The amount of sulfur-containing compound in the hydraulic fluid concentrate of the invention (when a concentrate is used) is generally about 0 to 10 percent by weight. The concentration of the phosphate ester in the hydraulic fluid concentrate of the invention is generally about 0 to 7.0 percent by weight of the concentrate. The concentration of the water-soluble ester of the ethoxylated aliphatic acid and/or ethoxylated alcohol ether in the hydraulic fluid concentrate of the invention is generally about 0 percent to about 7.0 percent by weight. The minimum amount of any of the above components when incorporated in the concentrate is 1.0 percent. Preferably, the proportion by weight of each of these three components is 1.0 to 5.0 percent in a high water fluid concentrate. They generally are not present in a water-glycol fluid.

The percent by weight alkanolamide in the concentrate is about 1 to 7, preferably about 1 to 5 based upon the total weight of the concentrate.

The metal deactivators and corrosion inhibitors which can be added either to the concentrate or to the hydraulic fluid or metalworking compositions of the invention are as follows:

Liquid-vapor corrosion inhibitors may be employed and can be any of the alkali metal nitrites, nitrates and benzoates. Certain amines are also useful. The inhibitors can be used individually or in combinations. Representative examples of the preferred alkali metal nitrates and benzoates which are useful are as follows: sodium nitrate, potassium nitrate, calcium nitrate, barium nitrate, lithium nitrate, strontium nitrate, sodium benzoate, potassium benzoate, calcium benzoate, barium benzoate, lithium benzoate and strontium benzoate.

Representative amine-type corrosion inhibitors are as follows: butylamine, propylamine, n-octylamine, hexylamine, morpholine, N-ethyl morpholine, N-methyl morpholine, aniline, triphenylamine, aminotoluene, ethylene diamine, dimethylaminopropylamine, N,N-dimethyl ethanolamine, triethanolamine, diethanolamine, monoethanolamine, 2-methyl pyridine, 4-methyl pyridine, piperazine, dimethyl morpholine, α- and γ-picoline, isopropylaminoethanol and 2- amino-2-methylpropanol. These amines also function to neutralize the free acid form of the phosphate ester converting it to the salt form.

Imidazolines can be used for their known corrosion inhibiting properties with respect to cast iron and steel. Useful imidazolines are heterocyclic nitrogen compounds having the formula:

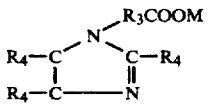

wherein $R_4$ is hydrogen or a monovalent radical selected from the group consisting of alkyl of 1 to 18 carbon atoms, alkylene of 1 to 18 carbon atoms, aryl, and alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal.

It is also contemplated to add other known corrosion inhibitors. Besides the amines, alkali metal nitrates, benzoates and nitrites listed above, the alkoxylated fatty acids are useful as corrosion inhibitors.

The above corrosion inhibitors are employed in the hydraulic fluid concentrates in total amount of about 2 to 25 percent by weight, preferably about 5 to 15 percent by weight. More specifically, it is preferred to employ one or more of the following as corrosion inhibitor: benzoates or benzoic acid in amount of about 1 to 5 percent, amines in amount of about 2 to 10 percent, and imidazolines in amount of about 2 to 10 percent all by weight of the total amount of concentrate.

Metal deactivators may be used primarily to chelate copper and copper alloys. Such materials are well known in the art and individual compounds can be selected from the broad classes of materials useful for this purpose such as the various triazoles and thiazoles as well as the amine derivatives of salicylidenes. Representative specific examples of these metal deactivators are as follows: benzotriazole, tolyltriazole, 2-mercaptobenzothiazole, sodium 2-mercaptobenzothiazole, and N,N'-disalicylidene-1,2- propanediamine. The concentration of metal deactivator to water in the hydraulic fluid concentrates of the invention is generally about 2 to 10 percent by weight and preferably about 3 to 5 percent by weight.

Conventional defoamers such as the well known organic surfactant defoamers, for example nonionic defoamers such as the polyoxyalkylene type nonionic surfactants, may also be employed in normal amounts. Preferred amounts are about 0.5 to 5.0 percent by weight of the total amount of concentrate.

Lower alcohols, i.e., those with about 2 to 10 carbon atoms, for example, methanol, ethanol, propanol, ethylene glycol, propylene glycol, diethylene glycol, triethylene glycol and glycerol, may also be employed in normal amounts. Ethylene glycol and propylene glycol are preferred. Preferred amounts of lower alcohols when employed are about 5 to 80 percent by weight of the concentrate. Where large amounts of lower alcohols are used, such as in so-called water-glycol fluids, the fluid is not normally sold as a concentrate but is sold as a ready-to-use fluid. The concentrate may contain other conventional hydraulic fluid additives and possibly some impurities in normal minimal amounts.

The phosphate esters and esters of ethoxylated aliphatic acids and alcohols are water-soluble in the sense that no special method is required to disperse these materials in water and keep them in suspension over long periods of time. As a means of reducing corrosion, the pH of the water in the fluids of the invention is maintained above 7.0, preferably 7.0 to about 11.0, and most preferably 9 to about 10.5. Preferably, pH of the fluid concentrates is adjusted with an alkali metal or alkaline earth metal hydroxide, or carbonate, ammonia or an amine. Where these are employed, benzoic acid may be employed in lieu of alkali metal benzoates. The sulfurized molybdenum or antimony compounds on the other hand are insoluble in water and require emulsification prior to use, for instance, with anionic or nonionic surfactants. Useful representative anionic or nonionic surfactants are: sodium petroleum sulfonate, i.e., sodium dodecylbenzene sulfonate; polyoxyethylated fatty alcohol or fatty acid and polyoxyethylated alkyl phenol.

The concentrates of the hydraulic fluids of this invention can be made up completely free of water or contain any desired amount of water but preferably contain up to 85 percent by weight of water to increase fluidity and provide ease of blending at the point of use. As pointed out above, these concentrates are typically diluted with water in the proportion of 1:99 to 75:25 to make up the final hydraulic fluid.

The preferred final hydraulic fluid of the invention may include 25 to 99 percent by weight water and by weight one or more of the following conventional additives:

about 0.01 to 3.0 percent water soluble ester of ethoxylated aliphatic acid and/or ethoxylated alcohol ether, about 0.01 to 2.0 percent sulfur-containing compound, about 0.01 to 3.0 percent ethoxylated phosphate ester, or salt thereof, about 0.01 to 3 percent alkanolamide, about 0.05 to 10 percent corrosion inhibitors, and most preferably one or more of the following three corrosion inhibitors in amount of about 0.01 to 2 percent benzoic acid and/or benzoates, about 0.02 to 3 percent amine type corrosion inhibitors and about 0.02 to 2 percent ethoxylated imidazoline; about 0.02 to 5 percent metal deactivators, about 0.01 to 2.0 percent defoamers and about 1 to 50 percent lower alcohol, plus other conventional additives such as dyes and impurities in normal amounts.

The following examples more fully describe the hydraulic fluids of the invention and show the unexpected results obtained by their use.

Thickener #1 is a branched heteric copolymer of ethylene oxide, and 1,2-propylene oxide having a molecular weight of 16,000 using trimethylolpropane as an initiator and containing 85 percent oxyethylene units, and 15 percent oxypropylene units. This basic heteric copolymer is further reacted with a mixture of alpha olefin epoxides having 15 to 18 carbon atoms.

Thickener #2 is a branched heteric copolymer of ethylene oxide and 1,2-propylene oxide using trimethylol propane as an initiator and containing 85 percent oxyethylene units, and 15 percent oxypropylene units. This basic heteric copolymer is further reacted with a mixture of alpha-olefin epoxides having 15 to 18 carbon atoms. The total molecular weight is approximately 17,000.

Thickener #3 is a branched heteric copolymer of ethylene oxide and 1,2-propylene oxide using trimethylol propane as an initiator and containing approximately 85 percent oxyethylene units, and approximately 15 percent oxypropylene units. This basic heteric copolymer is further reacted with a mixture of alpha olefin epoxides having 15 to 18 carbon atoms. The molecular weight is approximately 15,000.

The examples are intended for the purpose of illustration. Throughout the application, all parts, proportions, and percentages are by weight and all temperatures are in degrees centigrade unless otherwise noted.

EXAMPLES 1 AND 2

A hydraulic fluid inhibitor concentrate was prepared by blending 30 parts by weight morpholine and 8 parts by weight of a 50 percent by weight aqueous solution of sodium mercaptobenzothiazole.

From the concentrate two stock solutions of the composition of Table I below were prepared:

TABLE I

| | Weight % | |
|---|---|---|
| | Example #1 | Example #2 |
| Concentrate | 1.9 | 1.9 |
| Lauric Acid | 1.0 | 0 |
| Thickener #1 | 3.0 | 3.0 |
| Distilled Water | 94.1 | 95.1 |
| Viscosity (S.U.S.) | 526 | 53.1 |

As can be seen from Table I, the addition of just 1 percent lauric acid increased the viscosity of the hydraulic fluid almost ten times.

EXAMPLES 3-8

Eight hydraulic fluids were prepared by first blending the following components in the amounts set forth in Table II below:

TABLE II

| | Parts by Weight |
|---|---|
| Water | 45 |
| Ethylene Glycol | 38 |
| Sodium mercaptobenzothiazole (50% aqueous) | 0.5 |
| Mixed isopropylaminoethanol | 1.5 |
| Thickener #2 | 5.0 |

From the base fluid of Table II above, the hydraulic fluids of Examples 3 to 8 were prepared by blending the components in the amount set forth in Table III below. The viscosities of the fluids were determined at 100° F. and are set forth in Table III below:

TABLE III

| | Parts by Weight | | | | | |
|---|---|---|---|---|---|---|
| | 3 | 4 | 5 | 6 | 7 | 8 |
| Base Fluid of Table II | 90 | 90 | 90 | 90 | 90 | 90 |
| Lauric Acid | 0 | 0.1 | 0.2 | 0.5 | 1.0 | 1.5 |
| Water | 10 | 9.9 | 9.8 | 9.5 | 9 | 8.5 |
| Viscosity (S.U.S.) | 321 | 386 | 477 | 511 | 359 | 248 |

EXAMPLES 9-16

Eight hydraulic fluids were prepared by blending the following components in the amounts set forth in Table IV below. The viscosities of the fluids were determined at 100° F. and are set forth in Table IV below:

TABLE IV

| | Parts by Weight | | | | | | | |
|---|---|---|---|---|---|---|---|---|
| Example # | 9 | 10 | 11 | 12 | 13 | 14 | 15 | 16 |
| Triethanolamine | 1 | 1 | 0 | 1 | 1 | 1 | 1 | 0 |
| Morpholine | 1 | 1 | 0 | 1 | 1 | 1 | 1 | 0 |
| Sodium mercaptobenzothiazole (50%) | .5 | .5 | .5 | .5 | .5 | .5 | .5 | .5 |
| Ethylene glycol | 35 | 35 | 35 | 35 | 0 | 0 | 0 | 0 |
| Water | 56 | 57 | 58 | 61.5 | 93.5 | 94.5 | 96.5 | 95.5 |
| Thickener #3 | 5.5 | 5.5 | 5.5 | 0 | 3 | 3 | 0 | 3 |
| Capric acid | 1 | 0 | 1 | 1 | 1 | 0 | 1 | 1 |
| Viscosity, SUS, at 100° F. | 328 | 411 | 692 | 32 | 214 | 56 | 28 | 133 |

These examples demonstrate that (1) in a water-glycol formulation, the greatest effect is seen with acid and without amines; (2) in a high-water fluid, the greatest effect is seen in the presence of both amines and acid.

EXAMPLES 17-22

Eight hydraulic fluids were prepared by first blending the following components in the amounts set forth in Table V below:

TABLE V

| | Parts by Weight |
|---|---|
| Water | 94 |
| Sodium mercaptobenzothiazole (50%) | 0.5 |
| Morpholine | 1.0 |
| Triethanolamine | 1.0 |
| Thickener #2 | 2.5 |

From the base fluid of Table V above, the hydraulic fluids of Examples 17 to 22 were prepared by blending the components in the amounts set forth in Table VI below. The viscosities of the fluids were determined and are set forth in Table VI below:

TABLE VI

| | Parts by Weight | | | | | |
|---|---|---|---|---|---|---|
| Example # | 17 | 18 | 19 | 20 | 21 | 22 |
| Base Fluid of Table V | 99 | 99 | 99 | 99 | 99 | 99 |
| Lauric acid | 1 | — | — | — | — | — |
| Capric acid | — | 1 | — | — | — | — |
| Neodecanoic acid | — | — | 1 | — | — | — |
| Stearic acid | — | — | — | 1 | — | — |
| Palmitic acid | — | — | — | — | 1 | — |
| Water | — | — | — | — | — | 1 |
| Viscosity (SUS) at 100° F. | 56.9 | 81.6 | 69.8 | 1521.5 | 1677.8 | 54. |

EXAMPLES 23-26

Four hydraulic fluids were prepared by first blending 800 parts by weight of base fluid from Table V above with 4 parts by weight additional thickener #2, creating a new base fluid that is 0.5 percent richer in thickener construction. From this base fluid, the hydraulic fluids of Examples 23 to 26 were prepared by blending the components in the amounts set forth in Table VII below. The viscosities of the fluids were determined and are set forth in Table VII below:

TABLE VII

| | Parts by Weight | | | |
|---|---|---|---|---|
| Example # | 23 | 24 | 25 | 26 |
| New base stock | 99 | 99 | 99 | 99 |
| Lauric acid | 1 | — | — | — |
| Capric acid | — | 1 | — | — |
| Neodecanoic acid | — | — | 1 | — |
| Water | — | — | — | 1 |
| Viscosity (SUS) at 100° F. | 390 | 251 | 178 | 106 |

These examples show that: (1) small increases in the concentration of the thickener produce a large increase in viscosity in the presence of the organic acid (compare Examples 23-26 to Examples 17-19 and 22); (2) the straight chain acids show the effect more strongly but branched acids also show this effect.

The embodiments of the invention in which an exclusive privilege or property is claimed are defined as follows:

1. In a hydraulic fluid composition containing conventional hydraulic fluid additives, the improvement wherein said hydraulic fluid is characterized by improved viscosity said fluid consisting essentially of water, a carboxylic acid having about 5 to 20 carbon atoms, a thickener which is a polyether polyol having a molecular weight of about 1000 to about 40,000 prepared by reacting ethylene oxide or ethylene oxide and at least one lower alkylene oxide having 3 to 4 carbon atoms with at least one active hydrogen-containing compound and at least one alpha-olefin oxide or alcohol or glycidyl ether having a carbon chain length of about 10 to about 24 aliphatic carbon atoms wherein said alpha-olefin oxide or alcohol or glycidyl ether is present in the amount of 1 to about 20 percent by weight based upon the total weight of said thickener.

2. The hydraulic fluid of claim 1 wherein said fluid is a concentrate in which the amount of carboxylic acid is at least about 0.5 percent by weight of the concentrate and the amount of said thickener is about 10 to 60 percent by weight of the concentrate.

3. The concentrate of claim 2 wherein said carboxylic acid is selected from the group consisting of lauric acid, capric acid, stearic acid, palmitic acid, oleic acid, sebacic acid, neodecanoic acid and 4-octylbenzoic acid.

4. The concentrate of claim 3 wherein said carboxylic acid is lauric acid.

5. The concentrate of claim 3 wherein said carboxylic acid is capric acid.

6. The concentrate of claim 3 wherein said carboxylic acid is stearic acid.

7. The concentrate of claim 3 wherein said carboxylic acid is palmitic acid.

8. The concentrate of claim 2 wherein said concentrate includes at least one additive selected from the group consisting of phosphate esters or salts thereof selected from the group consisting of

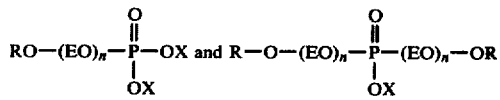

and mixtures thereof wherein ethylene oxide groups are represented by EO; R is selected from the group consisting of linear or branched chain alkyl groups wherein said alkyl groups have about 6 to 30 carbon atoms, preferably about 8 to 20 carbon atoms, or alkylaryl groups wherein the alkyl groups have about 6 to 30 carbon atoms, preferably about 8 to 18 carbon atoms, and X is selected from the group consisting of hydrogen, alkali or alkaline earth metal, the residue of ammonia or an amine and mixtures thereof, and n is a number from 1 to 50;

an alkyldialkanolamide of the formula

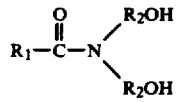

wherein $R_1$ is alkyl of about 4 to about 54 carbon atoms and $R_2$ is alkyl of about 2 to about 6 carbon atoms, a metal deactivator;

a corrosion inhibitor;

a defoamer;

water-soluble ethers or esters of ethoxylated $C_8$-$C_{36}$ aliphatic monohydric or polyhydric alcohols or acids, sulfur compound additives selected from the group consisting of the ammonia, amine or metal salts of 2-mercaptobenzothiazole or 5-, 6- and 7-substituted 2-mercaptobenzothiazole, and sulfurized molybdenum and antimony compounds represented by the formula:

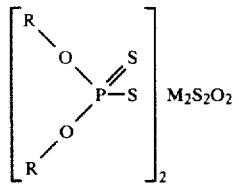

wherein M is molybdenum or antimony and R is organic and is selected from the group consisting of $C_3$–$C_{20}$ alkyl, aryl, alkylaryl radicals and mixtures thereof, and lower alcohol.

9. The concentrate of claim 8 wherein the amount of said additives when employed is by weight about 1.0 to 7.0 percent phosphate ester, about 1.0 to 7.0 percent alkyl dialkanolamide, about 2 to 10 percent metal deactivator, about 0.5 to 5 percent defoamer, about 2 to 25 percent corrosion inhibitor, about 1 to 7 percent of said water-soluble ethers or esters; about 1 to 10 percent of said sulfur compound, and about 5 to 80 percent lower alcohol.

10. The concentrate of claim 9 wherein said lower alcohol is ethylene glycol or propylene glycol.

11. The concentrate of claim 9 wherein said lower alcohol is ethylene glycol.

12. The concentrate of claim 8 wherein said corrosion inhibitors include nitrates; nitrites; benzoates; amines, and imidazolines having the formula:

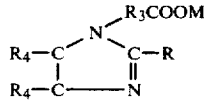

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal and said lower alcohol is ethylene glycol or propylene glycol.

13. The concentrate of claim 12 wherein the amount by weight of said additives when employed is as follows: phosphate ester about 1.0 to 7.0 percent, said alkyl dialkanolamide about 1.0 to 7.0 percent, said metal deactivator about 2.0 to 10.0 percent, said defoamer about 0.5 to 5.0 percent, said imidazoline about 2.0 to 10.0 percent, said benzoate about 1.0 to 5.0 percent, said amine about 2.0 to 10.0 percent, said water-soluble ether or ester about 1.0 to 7.0 percent, said sulfur compound about 1 to 10 percent, and said lower alcohol about 5 to 80 percent.

14. The hydraulic fluid of claim 1 containing at least about 0.10 percent by weight of said carboxylic acid.

15. The hydraulic fluid of claim 14 wherein the amount of carboxylic acid is about 0.1 to 2 percent and said thickener is about 1 to 20 percent by weight of the hydraulic fluid.

16. The hydraulic fluid of claim 15 wherein said carboxylic acid is selected from the group consisting of lauric acid, capric acid, stearic acid, palmitic acid, oleic acid, sebacic acid, neodecanoic acid and 4-octylbenzoic acid.

17. The hydraulic fluid of claim 15 wherein said carboxylic acid is lauric acid.

18. The hydraulic fluid of claim 15 wherein said carboxylic acid is capric acid.

19. The hydraulic fluid of claim 15 wherein said carboxylic acid is stearic acid.

20. The hydraulic fluid of claim 15 wherein said carboxylic acid is palmitic acid.

21. The hydraulic fluid of claim 15 wherein said fluid includes at least one additive selected from the group consisting of phosphate esters or salts thereof selected from the group consisting of

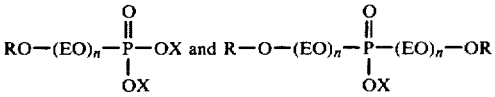

and mixtures thereof wherein ethylene oxide groups are represented by EO; R is selected from the group consisting of linear or branched chain alkyl groups wherein said alkyl groups have about 6 to 30 carbon atoms, preferably about 8 to 20 carbon atoms, or alkylaryl groups wherein the alkyl groups have about 6 to 30 carbon atoms, preferably about 8 to 18 carbon atoms, and X is selected from the group consisting of hydrogen, alkali or alkaline earth metal, the residue of ammonia or an amine and mixtures thereof, and n is a number from 1 to 50;

an alkyldialkanolamide of the formula

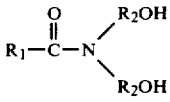

wherein $R_1$ is alkyl of about 4 to about 54 carbon atoms and $R_2$ is alkyl of about 2 to about 6 carbon atoms, a metal deactivator;

a defoamer a corrosion inhibitor;

water-soluble ethers or esters of ethoxylated $C_8$–$C_{36}$ aliphatic monohydric or polyhydric alcohols or acids, sulfur compound additives selected from the group consisting of the ammonia, amine or metal salts of 2-mercaptobenzothiazole or 5-, 6- and 7-substituted 2-mercaptobenzothiazole, and sulfurized molybdenum and antimony compounds represented by the formula:

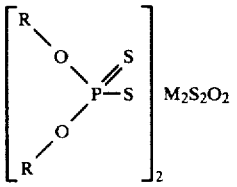

wherein M is molybdenum or antimony and R is organic and is selected from the group consisting of $C_3$-$C_{20}$ alkyl, aryl, alkylaryl radicals and mixtures thereof, and lower alcohol.

22. The hydraulic fluid of claim 21 wherein the amount of said additives is by weight about 0.01 to 3.0 percent phosphate ester, about 0.01 to 3.0 percent alkyl dialkanolamide, about 0.02 to 5.0 percent metal deactivator, about 0.01 to 2.0 percent defoamer, about 0.05 to 10 percent corrosion inhibitor, about 0.01 to 3 percent of said water-soluble ethers or esters, about 0.01 to 2 percent of said sulfur compound, and about 1.0 to 50 percent lower alcohol.

23. The concentrate of claim 22 wherein said lower alcohol is ethylene glycol or propylene glycol.

24. The concentrate of claim 22 wherein said lower alcohol is ethylene glycol.

25. The hydraulic fluid of claim 21 wherein said corrosion inhibitors include nitrates; nitrites; benzoates; amines, and imidazolines having the formula:

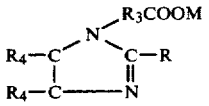

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal and said lower alcohol is ethylene glycol or propylene glycol.

26. The hydraulic fluid of claim 25 wherein the amount by weight of said additives when employed is as follows: said phosphate ester about 0.01 to 3.0 percent, said alkyl dialkanolamide about 0.01 to 3 percent, said metal deactivator about 0.02 to 5.0 percent, said defoamer about 0.01 to 2 percent, said imidazoline about 0.02 to 2 percent, said benzoate about 0.01 to 2 percent, said amine about 0.02 to 3 percent, said water soluble ethers or esters about 0.01 to 3 percent, said sulfur-containing compound about 0.01 to 2 percent, and said lower alcohol about 1.0 to 50 percent.

27. In a method for improving viscosity of a hydraulic fluid containing a thickener and conventional hydraulic fluid additives, the improvement wherein said thickener is a polyether polyol having a molecular weight of about 1000 to about 40,000 prepared by reacting ethylene oxide or ethylene oxide and at least one lower alkylene oxide having 3 to 4 carbon atoms with at least one active hydrogen-containing compound and at least one alpha-olefin oxide or alcohol or glycidyl ether having a carbon chain length of about 10 to about 24 aliphatic carbon atoms wherein said alpha-olefin oxide or alcohol or glycidyl ether is present in the amount of 1 to about 20 percent by weight based upon the total weight of said thickener, comprising blending therewith a carboxylic acid having 5 to 20 carbon atoms.

28. The method of claim 27 wherein the amount of carboxylic acid is at least about 0.1 percent and the amount of said thickener is about 1 to 20 percent by weight of the hydraulic fluid.

29. The method of claim 28 wherein said carboxylic acid is selected from the group consisting of lauric acid, capric acid, neodecanoic acid, stearic acid, palmitic acid, oleic acid, sebacic acid, and 4-octylbenzoic acid.

30. The method of claim 29 wherein said carboxylic acid is lauric acid.

31. The method of claim 29 wherein said carboxylic acid is capric acid.

32. The method of claim 29 wherein said carboxylic acid is neodecanoic acid.

33. The method of claim 29 wherein said carboxylic acid is stearic acid.

34. The method of claim 29 wherein said carbxoylic acid is palmitic acid.

35. The method of claim 29 wherein said hydraulic fluid includes at least one additive selected from the group consisting of phosphate esters or salts thereof selected from the group consisting of

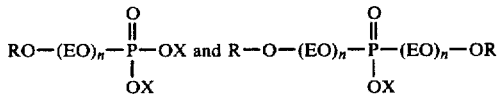

and mixtures thereof wherein ethylene oxide groups are represented by EO; R is selected from the group consisting of linear or branched chain alkyl groups wherein said alkyl groups have about 6 to 30 carbon atoms, preferably about 8 to 20 carbon atoms, or alkylaryl groups wherein the alkyl groups have about 6 to 30 carbon atoms, preferably about 8 to 18 carbon atoms, and X is selected from the group consisting of hydrogen, alkali or alkaline earth metal, the residue of ammonia or an amine and mixtures thereof, and n is a number from 1 to 50;

an alkyldialkanolamide of the formula

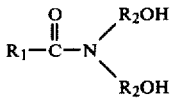

wherein $R_1$ is alkyl of about 4 to about 54 carbon atoms and $R_2$ is alkyl of about 2 to about 6 carbon atoms, a metal deactivator;

a defoamer a corrosion inhibitor;

water-soluble ethers or esters of ethoxylated $C_8$-$C_{36}$ aliphatic monohydric or polyhydric alcohols or acids, sulfur compound additives selected from the group consisting of the ammonia, amine or metal salts of 2-mercaptobenzothiazole or 5-, 6- and 7-substituted 2-mercaptobenzothiazole, and sulfurized molybdenum and antimony compounds represented by the formula:

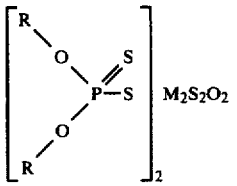

wherein M is molybdenum or antimony and R is organic and is selected from the group consisting of $C_3$–$C_{20}$ alkyl, aryl, alkylaryl radicals and mixtures thereof, and lower alcohol.

36. The method of claim 35 wherein the amount of said additives in said hydraulic fluid when employed, is by weight about 0.01 to 3.0 percent phosphate ester, about 0.01 to 3.0 percent alkyl dialkanolamide, about 0.02 to 5.0 percent metal deactivator, about 0.01 to 2.0 percent defoamer, about 0.05 to 10 percent corrosion inhibitor, about 0.01 to 3 percent of said water-soluble ethers or esters; about 0.01 to 2 percent of said sulfur compound, and about 1.0 to 50 percent lower alcohol.

37. The method of claim 36 wherein said lower alcohol is ethylene glycol or propylene glycol.

38. The method of claim 36 wherein said lower alcohol is ethylene glycol.

39. The method of claim 35 wherein said additional corrosion inhibitors include nitrates; nitrites; benzoates; amines, and imidazolines having the formula:

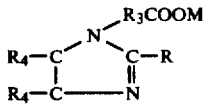

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal and said lower alcohol is ethylene glycol or propylene glycol.

40. The method of claim 39 wherein the amount by weight of said additives when employed is as follows: said phosphate ester about 0.01 to 3.0 percent, said alkyl dialkanolamide about 0.01 to 3 percent, said metal deactivator about 0.02 to 5.0 percent, said defoamer about 0.01 to 2 percent, said imidazoline about 0.02 to 2 percent, said benzoate about 0.01 to 2.0 percent, said amine about 0.02 to 3 percent, said water-soluble ethers or esters about 0.01 to 3 percent, said sulfur-containing compound about 0.01 to 2 percent, and said lower alcohol about 1.0 to 50 percent.

41. The method of claim 3 wherein said carboxylic acid is neodecanoic acid.

42. The method of claim 15 wherein said carboxylic acid is neodecanoic acid.

* * * * *